US011679520B2

(12) United States Patent
Hashimoto et al.

(10) Patent No.: US 11,679,520 B2
(45) Date of Patent: Jun. 20, 2023

(54) ELECTRIC RAZOR

(71) Applicant: Panasonic Intellectual Property Management Co., Ltd., Osaka (JP)

(72) Inventors: Toshiharu Hashimoto, Osaka (JP); Shunsuke Komori, Shiga (JP); Kotaro Yanagi, Shiga (JP); Akitaka Ito, Kyoto (JP); Hiroaki Shimizu, Shiga (JP); Daisuke Sone, Shiga (JP)

(73) Assignee: PANASONIC INTELLECTUAL. PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 17/576,275

(22) Filed: Jan. 14, 2022

(65) Prior Publication Data

US 2022/0314472 A1 Oct. 6, 2022

(30) Foreign Application Priority Data

Mar. 30, 2021 (JP) ..... JP2021-058792

(51) Int. Cl.
*B26B 19/04* (2006.01)
*B26B 19/10* (2006.01)

(52) U.S. Cl.
CPC ..... *B26B 19/048* (2013.01); *B26B 19/10* (2013.01)

(58) Field of Classification Search
CPC ..... B26B 19/00; B26B 19/04; B26B 19/048; B26B 19/10
See application file for complete search history.

(56) References Cited

U.S. PATENT DOCUMENTS 3,590,482 A * 7/1971 Carr ..... B26B 19/265 30/41.6
4,490,905 A * 1/1985 Riemersma ..... B26B 19/38 30/34.1
4,606,122 A * 8/1986 Ullmann ..... B26B 19/38 30/43.6

(Continued)

FOREIGN PATENT DOCUMENTS

EP 2208590 A1 7/2010
JP H07-299262 A 11/1995
JP 2011-067421 A 4/2011

OTHER PUBLICATIONS

The Extended European Search Report dated Jun. 28, 2022 for the related European Patent Application No. 22151828.5.

*Primary Examiner* — Adam J Eiseman
*Assistant Examiner* — Richard D Crosby, Jr.
(74) *Attorney, Agent, or Firm* — McDermott Will & Emery LLP

(57) ABSTRACT

The present disclosure provides an electric razor in which a support frame that supports an outer blade and an inner blade, which constitute a block, can be smoothly removed. An electric razor according to the present disclosure includes a main body gripped by a user and a head having a blade block including an outer blade (that is, a slit blade, a mesh blade) and an inner blade disposed inside the outer blade and sliding with respect to the outer blade. The head includes a base, a support frame that supports the blade block so as to be able to float and sink, a case held by the support frame, a hook that locks the support frame or the case to the base, and at least one push-up member that urges the support frame in a direction away from the base.

7 Claims, 7 Drawing Sheets

(56) References Cited

U.S. PATENT DOCUMENTS 4,926,552 A * 5/1990 Otsuka ..... B26B 19/04 30/346.51
5,163,227 A * 11/1992 Wolf ..... B26B 19/048 30/43.2
5,245,754 A * 9/1993 Heintke ..... B26B 19/048 30/43.92
5,542,179 A * 8/1996 Beutel ..... B26B 19/048 30/43.92
7,437,821 B2 * 10/2008 Oh ..... B26B 19/04 30/45
8,011,102 B2 * 9/2011 Sato ..... B26B 19/046 30/346.51
9,770,835 B2 * 9/2017 Eichhorn ..... B26B 19/048
9,808,943 B2 * 11/2017 Sato ..... B26B 19/048
10,071,490 B2 * 9/2018 Shimizu ..... B26B 19/048
10,583,573 B2 * 3/2020 Erndt ..... B26B 19/382
2008/0256799 A1 * 10/2008 Shiba ..... B26B 19/046 30/43.92
2010/0175263 A1 * 7/2010 Shimizu ..... B26B 19/28 30/45
2010/0180448 A1 * 7/2010 Sato ..... B26B 19/046 30/45
2012/0216409 A1 * 8/2012 Shigeta ..... B26B 19/288 30/43.91
2013/0074344 A1 * 3/2013 Shimizu ..... B26B 19/048 30/42
2014/0165406 A1 * 6/2014 Shimizu ..... B26B 19/048 30/43.1
2014/0182135 A1 * 7/2014 Kappes ..... B26B 19/048 30/42
2016/0151922 A1 * 6/2016 Shimizu ..... B26B 19/146 30/43
2016/0257008 A1 * 9/2016 Sato ..... B26B 19/048
2017/0225343 A1 * 8/2017 Suzuki ..... B26B 19/3866
2018/0333874 A1 * 11/2018 Shimizu ..... B26B 19/386

* cited by examiner

ELECTRIC RAZOR

CROSS-REFERENCE OF RELATED APPLICATIONS

This application claims the benefit of Japanese Application No. 2021-058792, filed on Mar. 30, 2021, the entire disclosure of which Application is incorporated by reference herein.

BACKGROUND

1. Technical Field

The present disclosure relates to an electric razor.

2. Description of the Related Art

Conventionally, the electric razor includes a main body configured to be gripped by a user, an outer blade detachably attached to the main body, and an inner blade that is disposed inside the outer blade and slides with respect to the outer blade (see, for example, PTL 1). The inner blade is urged toward the outer blade by an elastic body, so that the inner blade is always kept pressed against the outer blade when sliding. Since this urging force acts on the outer blade from the inner blade even when the outer blade is removed from the main body, the outer blade can be removed smoothly.

CITATION LIST

Patent Literature

PTL 1: Unexamined Japanese Patent Publication No. 7-299262

SUMMARY

In recent years, an electric razor in which an outer blade and an inner blade, which constitute a block, are supported by a support frame in a head in a floatable and sinkable way is also known. In the case of such an electric razor, the inner blade is urged against the outer blade in one block. For this reason, when the support frame is removed from the head, the urging force against the inner blade cannot be applied to the support frame, and thus it is difficult to smoothly remove the support frame.

Therefore, an object of the present disclosure is to provide an electric razor in which a support frame that supports an outer blade and an inner blade, which constitute a block, can be smoothly removed.

In order to achieve the above object, an electric razor according to an aspect of the present disclosure includes a main body configured to be gripped by a user and a head having a blade block including an outer blade and an inner blade, the inner blade being disposed inside the outer blade and sliding with respect to the outer blade, and the head includes a base, a support frame that supports the blade block so as to be able to float and sink, a case covering the support frame, a hook that locks the support frame or the case to the base, and at least one push-up member that urges the support frame in a direction away from the base.

In the electric razor of the present disclosure, the support frame that supports an outer blade and an inner blade, which constitute a block, can be smoothly removed.

DETAILED DESCRIPTION

Hereinafter, an exemplary embodiment of an electric razor according to the present disclosure will be described with reference to the drawings. Note that the following exemplary embodiment is an example for describing the present disclosure, and is not intended to limit the present disclosure. For example, a shape, a structure, a material, a component, a relative positional relationship, a connection state, a numerical value, a mathematical expression, the contents of each step and the order of the individual steps in a method, and the like described in the following exemplary embodiment are merely examples, and may include the contents that are not described below. In addition, geometric expressions such as parallel and orthogonal may be used, but these expressions do not indicate mathematical strictness, and include substantially acceptable errors, deviations, and the like. Furthermore, expressions such as simultaneous and identical include substantially acceptable ranges. Moreover, the drawings are schematic views in which emphasis, omission, and ratio adjustment are appropriately performed in order to describe the present disclosure, and may have shapes, positional relationships, and ratios that are different from actual shapes, positional relationships, and ratios.

Further, in the following, a plurality of aspects may be comprehensively described as one exemplary embodiment. In addition, some of the contents described below are described as optional components related to the present disclosure.

(Configuration of Electric Razor)

Figure 1:
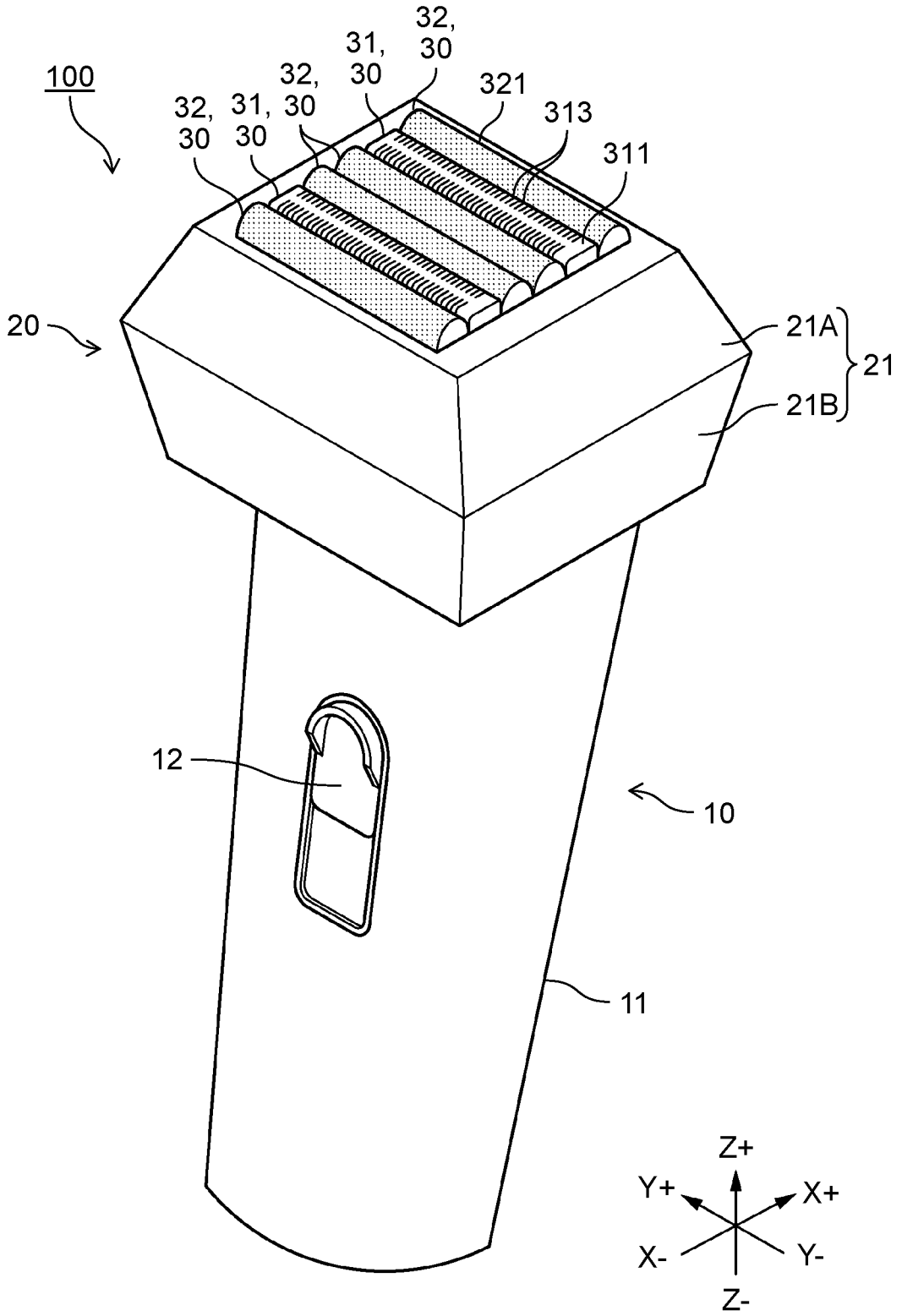
FIG. 1 is a perspective view illustrating a schematic configuration of an electric razor according to an exemplary embodiment.

FIG. 1 is a perspective view illustrating an electric razor. Note that electric razor 100 has portions that include a rounded edge, and recesses and protrusions for preventing slippage, but these portions are not illustrated.

As illustrated in FIG. 1, electric razor 100 includes main body 10 having a plurality of components constituting electric razor 100, head 20 having a hair shaving function, and head support part 50 (see FIG. 2) connecting main body 10 and head 20. Main body 10 includes grip 11 configured to be gripped by a user, power switch 12 switching on and off of power supply of main body 10, and a power supply unit (not illustrated) supplying power to a drive source (not illustrated) built in head 20.

Figure 2:
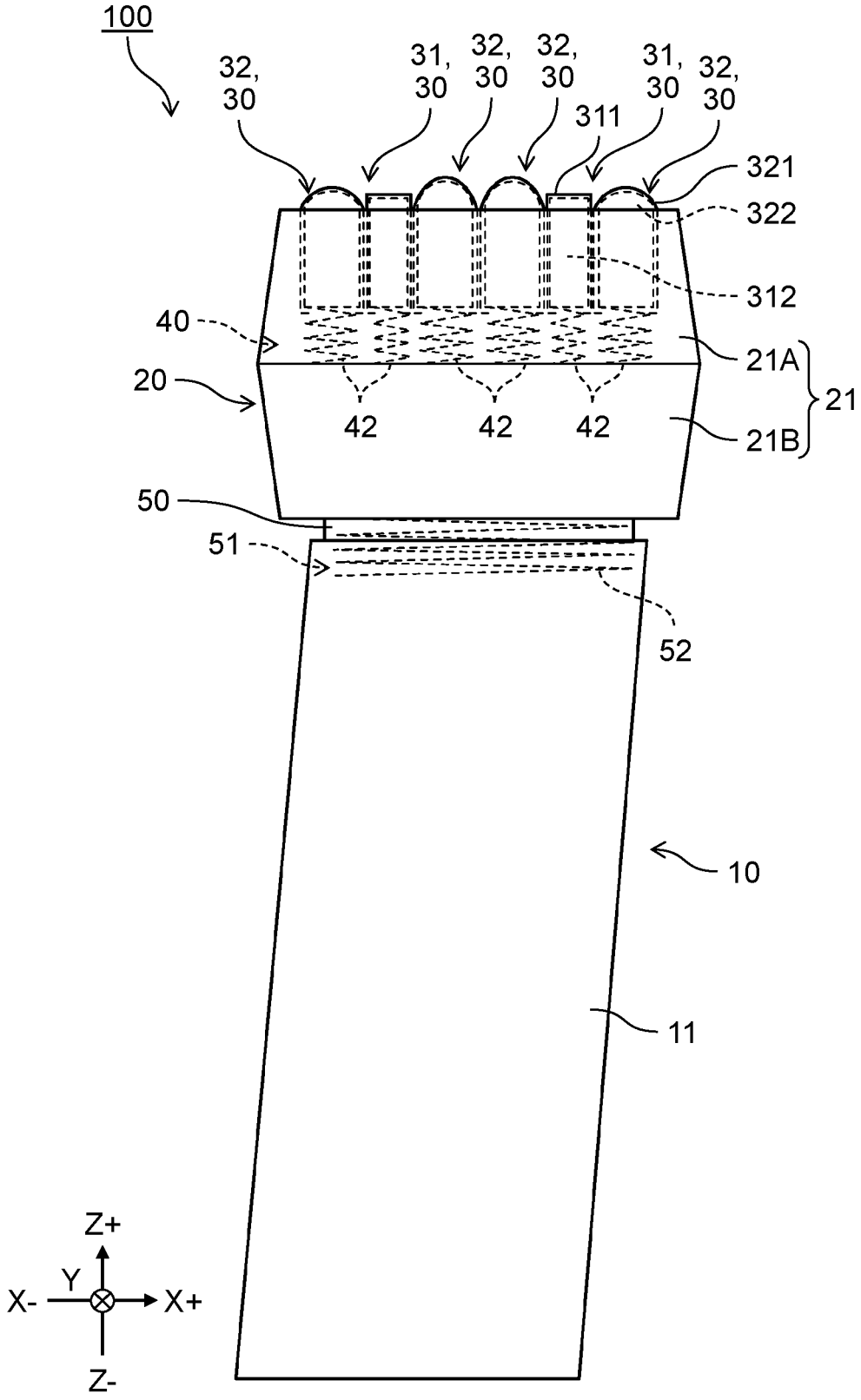
FIG. 2 is a schematic view illustrating each float part of a head and a head support part according to the exemplary embodiment.

FIG. 2 is a schematic view illustrating each float part of head 20 and head support part 50 according to the exemplary embodiment. As illustrated in FIG. 2, head support part 50 has head float part 51 that supports head 20 in a floatable and sinkable way with respect to main body 10. Head float part 51 has elastic body 52 such as a spring or rubber that applies an urging force to head 20 in a direction in which head 20 floats (that is, separates) from main body 10. Head float part 51 keeps head 20 floating furthest from main body 10 in a case where head 20 does not receive an external force. When head 20 receives an external force, elastic body 52 contracts in head float part 51, and thus head 20 sinks toward main body 10.

Head 20 includes case 21 that constitutes appearance, a plurality of blade blocks 30, blade float part 40, and a drive source. The drive source is, for example, a linear motor and is connected to each blade block 30 via transmission mechanism 60 (see FIG. 5). As a result, power from the drive source is transmitted to each blade block 30 via transmission mechanism 60, and each blade block 30 operates accordingly.

Case 21 is a part that houses blade float part 40 and the drive source, and supports the plurality of blade blocks 30. Case 21 includes upper case 21A in which blade float part 40 and the plurality of blade blocks 30 are disposed and lower case 21B that houses the drive source. The upper end of each blade block 30 protrudes from an upper surface of upper case 21A. Case 21 is formed by connecting upper case 21A and lower case 21B to each other.

The plurality of blade blocks 30 are arranged in such a manner that their extending directions are parallel to the Y-axis direction. The plurality of blade blocks 30 include slit blade block 31 and mesh blade block 32. In the present exemplary embodiment, the plurality of blade blocks 30 include two slit blade blocks 31 and four mesh blade blocks 32. In the present exemplary embodiment, two slit blade blocks 31 are disposed at a predetermined interval in the X-axis direction. In the present exemplary embodiment, one mesh blade block 32 is disposed on each side of each slit blade block 31 in the X-axis direction. In other words, the plurality of blade blocks 30 are arranged in the order of mesh blade block 32, slit blade block 31, mesh blade block 32, mesh blade block 32, slit blade block 31, and mesh blade block 32 in the X-axis direction.

Slit blade block 31 is a part for cutting long hair that is difficult to shave with mesh blade block 32. Slit blade block 31 has slit blade 311 as an outer blade and inner blade 312. Slit blade 311 is a member that is elongated in the Y-axis direction and has an inverted U-shape as viewed in the Y-axis direction. As illustrated in FIG. 1, a plurality of slits 313 extending in the X-axis direction are formed at both ends in the X-axis direction on an upper surface of slit blade 311. The plurality of slits 313 are arranged in the Y-axis direction, and a part between slits 313 functions as a blade. Since slit blade 311 has a larger upper opening in a height direction than mesh blade 321, which will be described later, it is possible to introduce and cut hair longer than hair introduced by mesh blade block 32.

As illustrated in FIG. 2, inner blade 312 is a member that is disposed inside slit blade 311, slides against an inner surface of slit blade 311, and cuts hair having entered slits 313 with the part between slits 313 (see FIG. 1). The shape and operation mode of inner blade 312 are determined in relation to slit blade 311 and are not particularly limited. In the present exemplary embodiment, the shape of inner blade 312 is formed by arranging a plurality of blades matching the shape of the inner surface of slit blade 311 in an extending direction of slit blade 311 (the Y-axis direction in the drawing). The power of the drive source is transmitted to inner blade 312 via transmission mechanism 60 (see FIG. 5). Inner blade 312 is reciprocated in the extending direction of slit blade 311 (the Y-axis direction in the drawing) by the power transmitted from the drive source via transmission mechanism 60 (see FIG. 5). As a result, the hair having entered slits 313 is sandwiched and cut between the part between slits 313 and the blade of inner blade 312.

Mesh blade block 32 is a part for cutting hair shorter than hair cut by slit blade 311. Mesh blade block 32 has mesh blade 321 as an outer blade and inner blade 322. Mesh blade 321 is a member that is elongated in the Y-axis direction and has an inverted U-shape as viewed in the Y-axis direction, and has an upper surface that is curved to protrude in a cross section in the Y-axis direction. Mesh blade 321 is a member with a thickness thinner than the thickness of the upper surface of slit blade 311. Mesh blade 321 is a net blade made by bending a thin plate with multiple holes, and has a function of deep shaving to shave short hair from a root.

Inner blade 322 is a member that is disposed inside mesh blade 321, slides with respect to an inner surface of mesh blade 321, and cuts hair having entered each hole of mesh blade 321 with each hole. The shape and operation mode of inner blade 322 are determined in relation to mesh blade 321 and are not particularly limited. In the present exemplary embodiment, the shape of inner blade 322 is formed by arranging a plurality of blades matching the shape of the inner surface of mesh blade 321 in the extending direction of mesh blade 321 (the Y-axis direction in the drawing). The power of the drive source is transmitted to inner blade 322 via transmission mechanism 60 (see FIG. 5). Inner blade 322 is reciprocated in the extending direction of mesh blade 321 (the Y-axis direction in the drawing) by the power transmitted from the drive source via transmission mechanism 60. As a result, the hair having entered each hole of mesh blade 321 is sandwiched and cut between each hole and the blade of inner blade 312.

Blade float part 40 is a part that allows each blade block 30 to float and sink with respect to case 21. Blade float part 40 has a plurality of elastic bodies 42 such as springs or rubber that individually apply an urging force to blade blocks 30 in a direction in which blade block 30 floats (that is, separates) from case 21. Specifically, elastic body 42 is provided for each blade block 30, and thus can urge each blade block 30 individually. Each elastic body 42 is only required to urge each blade block 30 without restricting an operation of inner blade 312, 322 of each blade block 30. Blade float part 40 keeps each blade block 30 floating furthest from case 21 in a case where each blade block 30 does not receive an external force. When each blade block 30 receives an external force in a direction of sinking in (that is, approaching) case 21, each elastic body 42 contracts in blade float part 40, and thus each blade block 30 sinks toward case 21.

(Specific Configuration of Head)

Figure 3:
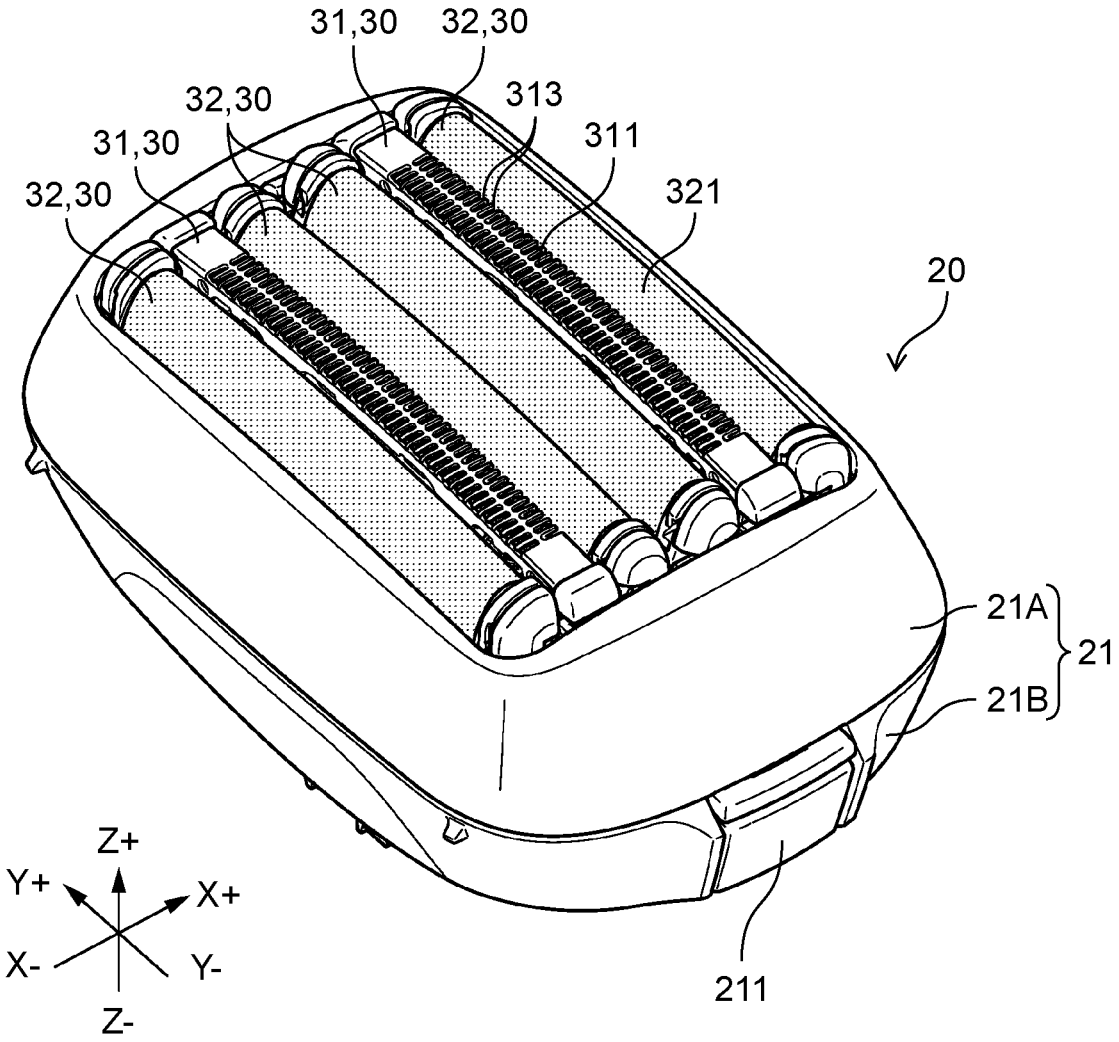
FIG. 3 is a perspective view of the head according to the exemplary embodiment.
Figure 4:
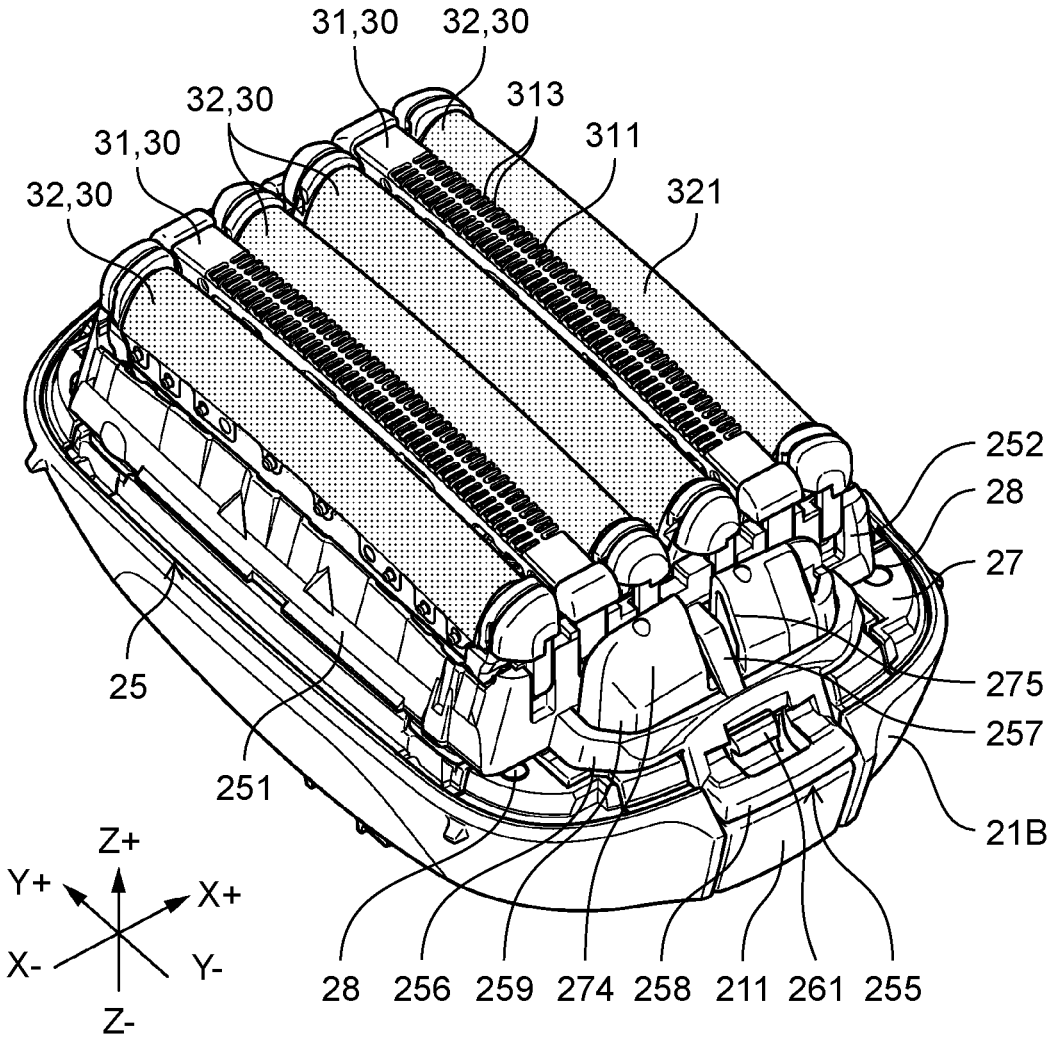
FIG. 4 is a perspective view illustrating a state where an upper case is removed in the head according to the exemplary embodiment.
Figure 5:
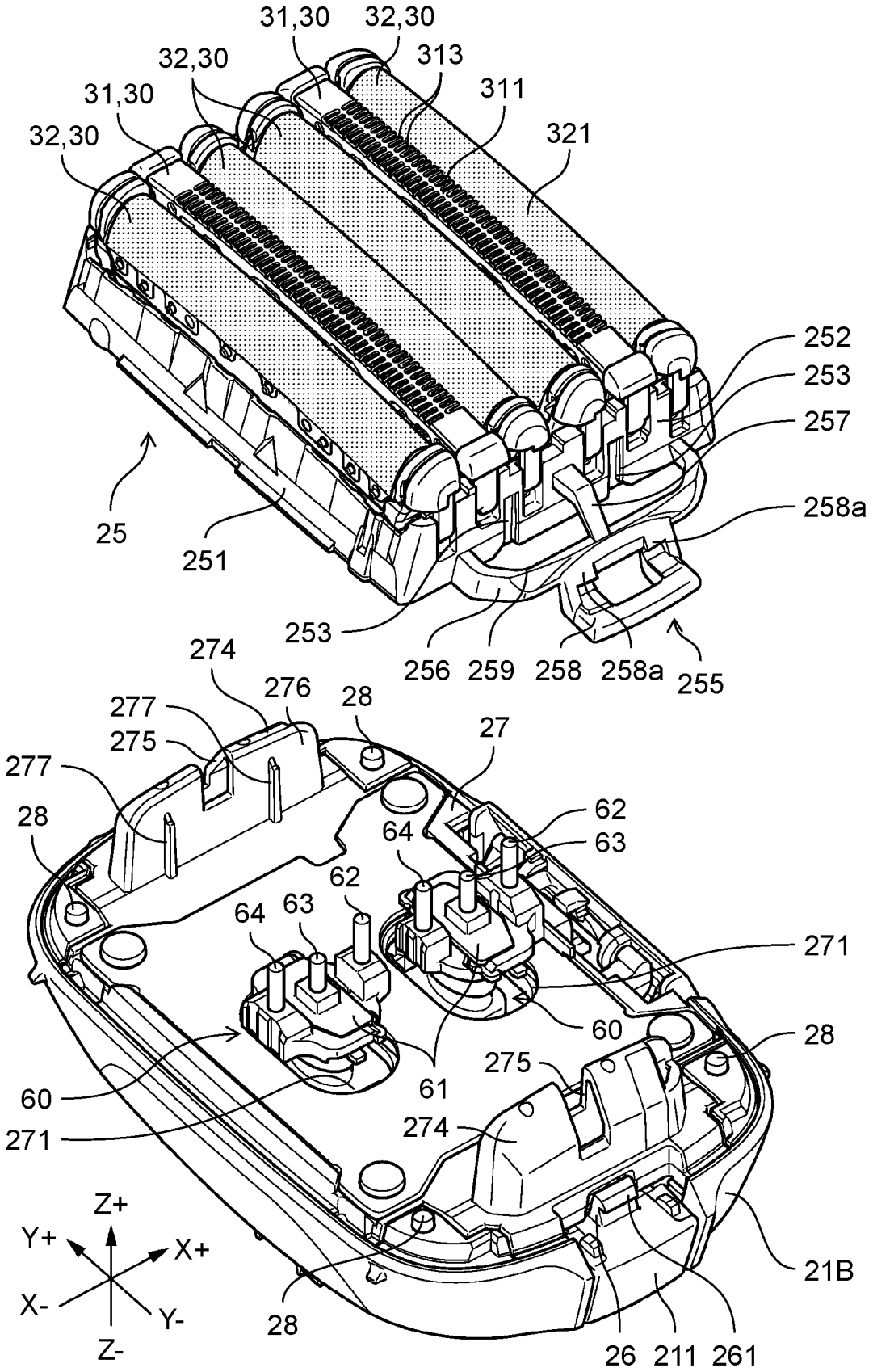
FIG. 5 is an exploded perspective view illustrating a state where a support frame is removed from a base in the head according to the exemplary embodiment.

Next, a specific configuration of head 20 will be described in detail. FIG. 3 is a perspective view of head 20 according to the exemplary embodiment. FIG. 4 is a perspective view illustrating a state where upper case 21A is removed in head 20 according to the exemplary embodiment. FIG. 5 is an exploded perspective view illustrating a state where support frame 25 is removed from base 27 in head 20 according to the exemplary embodiment.

As illustrated in FIGS. 3 to 5, in head 20, lower case 21B includes buttons 211 on both end faces in the Y-axis direction. Each button 211 is a part that operates hook 26, which will be described later, when pressed by a user. Each button 211 sinks toward the inside of lower case 21B while being urged toward the outside of lower case 21B.

As illustrated in FIG. 5, lower case 21B includes base 27 that detachably holds support frame 25. Base 27 is formed in a rectangular shape in a plan view (that is, as viewed in the Z-axis direction), and is housed in lower case 21B. A pair of openings 271 arranged in the X-axis direction are formed in the central portion of base 27. Transmission member 61, which is a part of transmission mechanism 60, protrudes from each opening 271. In each transmission member 61, three pin-shaped connecting members 62, 63, 64 are arranged in the X-axis direction, and each of pin-shaped connecting members 62, 63, 64 extends in the Z-axis direction and protrudes from base 27. That is, pin-shaped connecting members 62, 63, 64 extend in a direction intersecting a sliding direction of inner blades 312, 322 (that is, the Y-axis direction).

Inner blades 322 of mesh blade blocks 32 are attached to connecting members 62, 64 located at both ends in the X-axis direction, among three connecting members 62, 63, 64. In addition, inner blade 312 of slit blade block 31 is attached to connecting member 63 located at the central portion in the X-axis direction, among three connecting members 62, 63, 64. Specifically, a mounting hole (not illustrated) extending in the Z-axis direction is formed on the bottom surface side of each of inner blades 312, 322. By inserting pin-shaped connecting members 62, 63, 64 into mounting holes of inner blades 312, 322 from the negative direction of the Z axis, inner blades 312, 322 are attached to pin-shaped connecting members 62, 63, 64.

Furthermore, hooks 26 are disposed at both ends of base 27 in the Y-axis direction. Each hook 26 is provided integrally with button 211 provided in lower case 21B, and includes claw 261 protruding outward at its upper end. In FIGS. 3 to 5, only hook 26 in the negative direction of the Y axis is illustrated, and claw 261 of this hook 26 protrudes in the negative direction of the Y axis (that is, outward). On the other hand, although not illustrated, in hook 26 in the positive direction of the Y axis, claw 261 protrudes in the positive direction of the Y axis (that is, outward). Upper case 21A includes a first locking part (not illustrated) that is locked to support frame 25 (strictly, a pair of hooks 258*a* of protrusion 255 in support frame 25) and a second locking part (not illustrated) that is locked to claw 261 of each hook 26. Claw 261 of each hook 26 locks the second locking part (not illustrated) provided in upper case 21A, so that upper case 21A and support frame 25 held by upper case 21A are fixed to base 27. Protrusion 255 and the pair of hooks 258*a* will be described later. Furthermore, hook 26 moves inward of lower case 21B when button 211 is pressed by a user. As a result, claw 261 of hook 26 is retracted from the second locking part (not illustrated) provided in upper case 21A, and the locking state of upper case 21A and support frame 25 held by upper case 21A is released. With this release, upper case 21A and support frame 25 held by upper case 21A become removable from base 27. On the other hand, when the user stops pressing button 211, button 211 returns to the original position due to an urging force, so that hook 26 also returns to the original position.

Further, a pair of guide projections 274 projecting upward (that is, in the positive direction of the Z axis) are respectively provided between the pair of hooks 26 in the Y-axis direction at both ends of base 27 in the Y-axis direction. Each guide projection 274 is a part that guides the movement of support frame 25 in the Z-axis direction. Each guide projection 274 is formed in a tapered shape. Specifically, each guide projection 274 has a shape in which the widths in the Y-axis direction and the X-axis direction become narrower as guide projection 274 extends in the positive direction of the Z axis. Furthermore, notch 275 which has an open end in the positive direction of the Z axis and extends in the Y-axis direction is formed at the central portion of each guide projection 274 in the X-axis direction. Claw 261 of each hook 26 is disposed on the extension line of notch 275 in the Y-axis direction.

In each guide projection 274, inner surface 276 in the Y-axis direction is formed in a plane parallel to the XZ plane. A pair of protrusions 277 extending in the Z-axis direction are formed on this surface 276 so as to sandwich notch 275. Although surface 276 of guide projection 274 in the negative direction of the Y axis is not illustrated in FIG. 5, a pair of protrusions 277 are also formed on this surface 276. The pair of protrusions 277 are parts that guide the movement of support frame 25 in the Z-axis direction.

Figure 7:
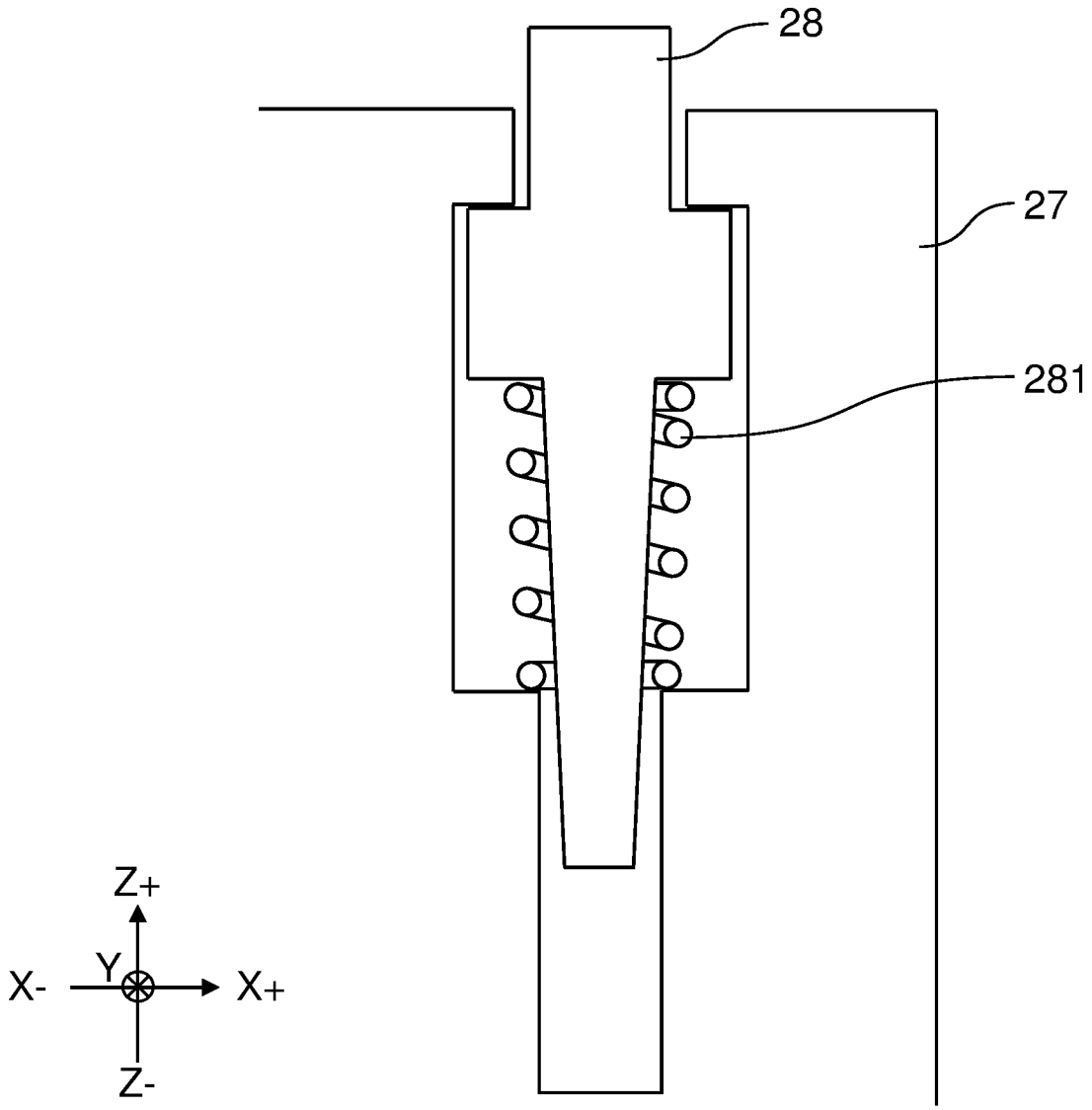
FIG. 7 is a schematic view illustrating a push-up member.

Further, push-up member 28 protruding in the positive direction of the Z axis is provided at each corner portion of base 27 in a plan view (as viewed in the Z-axis direction). Each push-up member 28 is a columnar member, and is provided so as to freely appear and disappear in the Z-axis direction from the upper surface of base 27. Each push-up member 28 is in a state where a spring member 281 provided inside base 27 always applies an urging force in the positive direction of the Z axis as shown in FIG. 7. By this urging force, each push-up member 28 urges support frame 25 in a direction away from base 27.

As illustrated in FIGS. 4 and 5, support frame 25 is a member that is attached to and detached from base 27 while integrally holding blade float part 40 and the plurality of blade blocks 30. Specifically, support frame 25 includes frame main body 251 and a pair of protrusions 255.

Frame main body 251 is a part that holds blade float part 40 and holds each blade block 30 so as to be movable in a floating and sinking direction. Frame main body 251 is formed in a rectangular shape in a plan view (that is, as viewed in the Z-axis direction). When support frame 25 is attached to base 27, corner portions of frame main body 251 come into contact with push-up members 28 of base 27 and push down push-up members 28. That is, in a state where support frame 25 is attached to base 27, corner portions of frame main body 251 continue to receive the urging force from push-up members 28. FIG. 4 illustrates a mode in which push-up members 28 stick out from the corner portions of frame main body 251. However, push-up members 28 may be housed in frame main body 251 as viewed in the Z-axis direction.

Furthermore, a pair of grooves 253 extending in the Z-axis direction are formed on both end surfaces 252 of frame main body 251 in the Y-axis direction. Although end surface 252 in the positive direction of the Y axis is not illustrated in FIG. 5, a pair of grooves 253 are also formed in this end surface 252. The pair of grooves 253 are parts into which the pair of protrusions 277 formed on surface 276 of guide projection 274 are inserted and that are guided by these protrusions 277.

Figure 6:
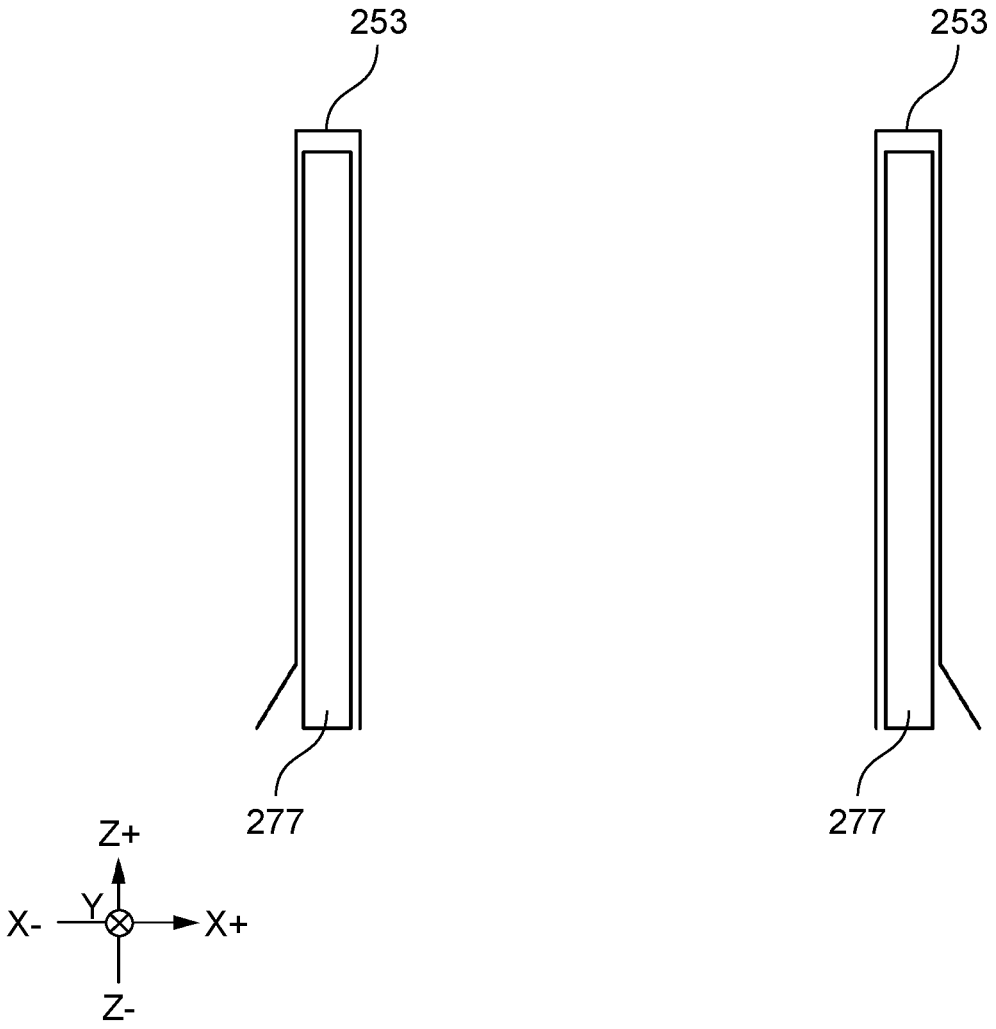
FIG. 6 is a schematic view illustrating a pair of grooves and a pair of protrusions according to the exemplary embodiment.

FIG. 6 is a schematic view illustrating the pair of grooves 253 and the pair of protrusions 277 according to the exemplary embodiment. As illustrated in FIG. 6, each groove 253 has an open end in the negative direction of the Z axis. The open end of each groove 253 has a shape that widens as it extends in the negative direction of the Z axis. More specifically, at the open end of each groove 253, the inner edge in the X-axis direction is formed in the Z-axis direction, and the outer edge in the X-axis direction is inclined with respect to the Z-axis direction. Since each groove 253 has such a shape, each protrusion 277 can be smoothly inserted into each groove 253. Further, since the inner edge in the X-axis direction is in the Z-axis direction at the open end of each groove 253, it is possible to make a guide distance at the time of attachment and detachment as long as possible.

As illustrated in FIGS. 4 and 5, the pair of protrusions 255 are parts protruding outward from both ends of frame main body 251 in the Y-axis direction. Although the end of frame main body 251 in the positive direction of the Y axis is not illustrated in FIG. 5, protrusion 255 is also formed at this end. Each protrusion 255 includes frame-shaped part 256, reinforcing part 257, and catch part 258.

Frame-shaped part 256 is a frame extending from an end portion of frame main body 251 in the Y-axis direction so as to form opening 259 that is elongated in the X-axis direction. Furthermore, reinforcing part 257 is a part connecting the central portion of frame-shaped part 256 in the X-axis direction and the end portion of frame main body 251 in the Y-axis direction. Frame-shaped part 256 is reinforced by reinforcing part 257. In addition, guide projection 274 of base 27 is inserted into opening 259 formed by frame-shaped part 256. Since guide projection 274 has a tapered shape as described above, guide projection 274 can be easily inserted into opening 259. Further, when opening 259 is directed to a base end of guide projection 274, guide projection 274 is fitted into opening 259, and thus position of support frame 25 is adjusted in each of the X-axis direction and the Y-axis direction. Moreover, reinforcing part 257 is housed in notch 275 of guide projection 274 (see FIG. 4).

Catch part 258 is a part protruding outward from the central portion of frame-shaped part 256 in the X-axis direction. Catch part 258 is formed in a U-shape in a plan view, and includes a pair of hooks 258*a* to which upper case 21A is locked on both sides of the opening. When claw 261 locks upper case 21A through the opening in catch part 258, support frame 25 is fixed to base 27 with upper case 21A locked to the pair of hooks 258*a*. Since claw 261 locks upper case 21A in this way, support frame 25 is kept fixed to base 27 even if each corner portion of frame main body 251 receives the urging force from each push-up member 28.

(Attachment and Detachment Operations of Support Frame)

Next, attachment and detachment operations of support frame 25 will be described. First, as illustrated in FIG. 5, an operation of each part when support frame 25 is attached to base 27 from the state where support frame 25 is removed from base 27 will be described. First, the user grabs upper case 21A in which support frame 25 is held and brings upper case 21A closer to base 27. At this time, the user inserts guide projections 274 into openings 259 of frame-like parts 256. As a result, opening 259 is directed to the base end of guide projection 274, and reinforcing part 257 is also housed in notch 275 of guide projection 274. During this movement, guide projection 274 is gradually fitted into opening 259, and position of support frame 25 is adjusted in each of the X-axis direction and the Y-axis direction. Consequently, position of grooves 253 of frame main body 251 and protrusions 277 of guide projection 274 is adjusted, position of blade blocks 30 and connecting members 62, 63, 64 are adjusted, and position of the second locking part (not illustrated) of upper case 21A and claw 261 is adjusted.

Furthermore, when support frame 25 is pressed against base 27 by the user, support frame 25 approaches base 27 while grooves 253 are guided by protrusions 277 formed on surface 276 of guide projection 274. The corner portions of frame main body 251 push down push-up members 28 accordingly, and the second locking part (not illustrated) of upper case 21A is moved across claw 261 of hook 26 and locked by claw 261. As a result, upper case 21A and support frame 25 held by upper case 21A are fixed to base 27. As described above, at the time of fixing, the corner portions of frame main body 251 always receive the urging force from push-up members 28. Here, in a case where claw 261 of hook 26 does not lock the second locking part (not illustrated) of upper case 21A, support frame 25 remains floating from base 27 due to the urging force of push-up members 28. Consequently, the user can find at a glance that support frame 25 is not properly attached.

Next, an operation of each part when support frame 25 is removed from base 27 will be described. The user operates hooks 26 by pressing buttons 211 to release the locking state of upper case 21A to the second locking part (not illustrated) by claw 261. As a result, the restriction of entire support frame 25 is released, so that upper case 21A and support frame 25 held by upper case 21A rise in response to the urging force from push-up members 28 and move away from base 27 (that is, in the positive direction of the Z axis). Also during this movement, grooves 253 are guided by protrusions 277 formed on surface 276 of guide projection 274, and thus support frame 25 rises while maintaining the state where position of blade blocks 30 and pin-shaped connecting members 62, 63, 64 has been adjusted. Consequently, the load on pin-shaped connecting members 62, 63, 64 at the time of removal is suppressed. After that, since support frame 25 remains floating from base 27, the user grabs upper case 21A and removes upper case 21A from base 27.

Effects

As described above, electric razor 100 according to the present exemplary embodiment includes main body 10 configured to be gripped by a user and head 20 having blade block 30 including an outer blade (that is, slit blade 311, mesh blade 321) and inner blade 312, 322, the inner blade 312, 322 being disposed inside the outer blade and sliding with respect to the outer blade. Head 20 includes base 27, support frame 25 that supports blade block 30 in a floatable and sinkable way, upper case 21A held by support frame 25, hook 26 that locks support frame 25 to base 27, and at least one push-up member 28 that urges support frame 25 in a direction away from base 27.

In the above, support frame 25 that supports blade block 30 in a floatable and sinkable way is urged by push-up member 28 in the direction away from base 27. Consequently, when the locking state of hook 26 is released, support frame 25 is separated from base 27 by the urging force applied from push-up member 28. As a result, support frame 25 that supports blade block 30 can be smoothly removed from upper case 21A held by support frame 25.

On the other hand, when support frame 25 is attached, it is assumed that claw 261 of hook 26 does not accurately lock the second locking part (not illustrated) of upper case 21A. In this case, support frame 25 remains floating from base 27 due to the urging force of each push-up member 28, which makes the user possible to find that support frame 25 and upper case 21A are not properly attached.

Furthermore, head 20 includes connecting members 62, 63, 64 that are connected to inner blades 312, 322, extend in a direction intersecting a sliding direction of inner blades 312, 322, and protrude from base 27, in order to transmit power from a motor to inner blades 312, 322.

In the above, support frame 25 can be smoothly removed even in electric razor 100 having connecting members 62, 63, 64 connected to inner blades 312, 322 in a state of protruding from base 27.

Further, push-up member 28 applies an urging force in an extending direction of connecting members 62, 63, 64 to support frame 25.

In the above, since push-up member 28 urges support frame 25 with the urging force in the extending direction of connecting members 62, 63, 64, when support frame 25 is separated from base 27 by the urging force, support frame 25 moves smoothly along connecting members 62, 63, 64. As a result, the load on connecting members 62, 63, 64 can be suppressed.

Moreover, support frame 25 includes frame main body 251 that has a rectangular shape in a plan view and holds blade block 30. Push-up member 28 is provided at a position corresponding to each corner portion of frame main body 251 in a plan view.

In the above, since push-up members 28 are provided at positions corresponding to the corner portions of frame main body 251, push-up members 28 can urge support frame 25 in a well-balanced manner. As a result, support frame 25 can be stably moved in the direction away from base 27.

Further, support frame 25 includes groove 253 extending in an urging direction of push-up member 28, and base 27 includes protrusion 277 configured to be guided by groove 253.

In the above, when support frame 25 is attached to and detached from base 27, groove 253 is guided by protrusion 277, so that support frame 25 can be smoothly moved. As a result, the load on support frame 25 at the time of attachment and detachment can be suppressed.

OTHERS

Although the electric razor according to the present disclosure has been described on the basis of the exemplary embodiment, the present disclosure is not limited to the exemplary embodiment.

For example, the exemplary embodiment has exemplified the case where each connecting member 62, 63, 64 has a pin shape. However, each connecting member 62, 63, 64 may have a prismatic shape. Furthermore, connecting members 62, 63, 64 may be integrally formed with transmission member 61, or may be individually formed and fixed to transmission member 61.

Further, the exemplary embodiment has exemplified the case where two protrusions 277 are provided to extend in the Z-axis direction on inner surface 276 of each guide projection 274 in the Y-axis direction. However, the number of protrusions 277 in each guide projection 274 may be one, or equal to or more than three.

Furthermore, the exemplary embodiment has described the case where each push-up member 28 is a columnar member. However, each push-up member 28 may have a prismatic shape other than a columnar shape. Each push-up member 28 may have a truncated cone shape, a pyramid shape, or the like. Moreover, push-up members 28 can have different shapes from one another. Regardless of the shape of push-up member 28, it is preferable that push-up member 28 has a shape capable of pushing up frame main body 251.

Furthermore, the exemplary embodiment has exemplified the case where frame main body 251 has a rectangular shape in a plan view. However, frame main body 251 may have a polygonal shape other than a rectangular shape. Regardless of the polygonal shape of frame main body 251, it is preferable that push-up member 28 is provided at a position corresponding to the corner portion of frame main body 251.

Furthermore, the position of push-up member 28 may be a position where push-up member 28 pushes up a straight portion of rectangular frame main body 251.

Moreover, the exemplary embodiment has exemplified the case where groove 253 extending in the urging direction of push-up member 28 is formed in support frame 25 and protrusion 277 configured to be guided by groove 253 is formed in base 27. However, groove 253 extending in the urging direction of push-up member 28 may be formed in base 27, and protrusion 277 configured to be guided by groove 253 may be formed in support frame 25.

Further, the number of grooves 253 extending in the urging direction of push-up member 28 does not need to be two, and may be one, or equal to or more than three as many as protrusions 277.

The exemplary embodiment has exemplified the case where four push-up members 28 in total are provided at four corner portions in one-to-one correspondence, so as to have the same shape as that of frame main body 251. However, the number of push-up members 28 is not limited to one at each corner portion, and a plurality of push-up members may be provided at one corner portion.

Furthermore, the exemplary embodiment has exemplified the case where hook 26 locks the second locking part (not illustrated) provided in upper case 21A. However, hook 26 may lock support frame 25.

Furthermore, the present disclosure includes a mode obtained by applying various modifications conceived by those skilled in the art to the exemplary embodiment, and a mode implemented by arbitrarily combining components and functions in the exemplary embodiment without departing from the gist of the present disclosure.

The present disclosure can be applied to an electric razor capable of shaving body hair of an animal including a human, such as a so-called electric shaver for shaving beard.

What is claimed is:

1. An electric razor comprising:

a main body configured to be gripped by a user; and a head having a blade block including an outer blade and an inner blade, the inner blade being disposed inside the outer blade and sliding with respect to the outer blade, wherein the head comprises:

a base, a support frame that supports the blade block in a floatable and sinkable way, a case held by the support frame, a hook that locks the support frame or the case to the base, and at least one push-up member that urges the support frame in a direction which is from the main body toward the head, and the at least one push-up member has a protruding shape in the direction from the base.

2. The electric razor according to claim 1, wherein the head comprises a connecting member that is connected to the inner blade, extends in a direction intersecting a sliding direction of the inner blade, and protrudes from the base, in order to transmit power from a motor to the inner blade.

3. The electric razor according to claim 2, wherein the at least one push-up member includes a spring that applies an urging force in an extending direction of the connecting member to the support frame.

4. The electric razor according to claim 1, wherein the at least one push-up member comprises four push-up members, the support frame includes a frame main body that has a rectangular shape in a plan view and holds the blade block, and the four push-up members are provided at positions corresponding to corner portions of the frame main body in the plan view.

5. The electric razor according to claim 1, wherein the base includes a groove extending in an urging direction of the at least one push-up member, and the support frame includes a protrusion configured to be guided by the groove.

6. The electric razor according to claim 1 wherein the support frame includes a groove extending in an urging direction of the at least one push-up member, and the base includes a protrusion configured to be guided by the groove.

7. An electric razor comprising:

a main body configured to be gripped by a user; and a head having a blade block including an outer blade and an inner blade, the inner blade being disposed inside the outer blade and sliding with respect to the outer blade, wherein the head comprises:

a base, a support frame that supports the blade block in a floatable and sinkable way and includes a groove extending in an urging direction of the at least one push-up member, a case held by the support frame, a hook that locks the support frame or the case to the base, and at least one push-up member that urges the support frame in a direction away from the base, and the base includes a protrusion configured to be engaged with and guided by the groove of the support frame.

* * * * *